US011976429B2

(12) United States Patent
Yuan et al.

(10) Patent No.: US 11,976,429 B2
(45) Date of Patent: May 7, 2024

(54) SHED TUNNEL STRUCTURE FOR PREVENTING FALLING ROCK

(71) Applicant: Sichuan Communication Surveying & Design Institute Co., Ltd., Sichuan (CN)

(72) Inventors: Song Yuan, Sichuan (CN); Xibao Wang, Sichuan (CN); Liangpu Li, Sichuan (CN); Peiyuan Liao, Sichuan (CN); Sheng Zhang, Sichuan (CN); Zhengzheng Wang, Sichuan (CN); Zhixiang Yu, Sichuan (CN); Tingbiao Zhang, Sichuan (CN); Guoqiang Zheng, Sichuan (CN); Junbing Li, Sichuan (CN); Yafeng Jin, Sichuan (CN); Weijin Zhou, Sichuan (CN); Lisong Gan, Sichuan (CN); Ke Zhou, Sichuan (CN); Jicheng Wei, Sichuan (CN); Daquan Zhao, Sichuan (CN)

(73) Assignee: Sichuan Communication Surveying & Design Institute Co., Ltd., Chengdu (CN)

( * ) Notice: Subject to any disclaimer, the term of this patent is extended or adjusted under 35 U.S.C. 154(b) by 261 days.

(21) Appl. No.: 17/734,313

(22) Filed: May 2, 2022

(65) Prior Publication Data

US 2022/0356657 A1 Nov. 10, 2022

(30) Foreign Application Priority Data

May 8, 2021 (CN) ..... 202110499603.0

(51) Int. Cl.
*E01F 7/04* (2006.01)

(52) U.S. Cl.
CPC ..... *E01F 7/045* (2013.01)

(58) Field of Classification Search
CPC ..... E01F 7/045; E01F 7/04
See application file for complete search history.

(56) References Cited

U.S. PATENT DOCUMENTS 2,594,928 A * 4/1952 Horowitz ..... E04H 1/005 52/592.1
3,282,056 A * 11/1966 Fisher ..... E02D 29/02 405/286

(Continued)

FOREIGN PATENT DOCUMENTS

CN 207376492 U 5/2018
CN 112240012 A 1/2021

(Continued)

*Primary Examiner* — Adriana Figueroa

(57) ABSTRACT

The present invention discloses a shed tunnel structure for preventing a falling rock, including a shed tunnel body and a buffer plate for bearing impact of the falling rock, where the shed tunnel body includes a first supporting structure, and the first supporting structure is arranged on a side away from a ramp; one end of the buffer plate is connected to the ramp; a side face of the buffer plate close to the shed tunnel body is in movable contact with the first supporting structure, and the contact position is close to the other end of the buffer plate. The objective of resisting continuous impact of the falling rock can be achieved through the structural design.

10 Claims, 5 Drawing Sheets

(56) References Cited

U.S. PATENT DOCUMENTS

| | | | | | |
|---|---|---|---|---|---|
| 4,727,701 | A * | 3/1988 | Figari | E04B 5/263 | 52/483.1 |
| 5,359,954 | A * | 11/1994 | Kordelin | B63B 3/68 | 52/391 |
| 2011/0179740 | A1 * | 7/2011 | Padmanabhan | E04F 15/041 | 403/375 |

FOREIGN PATENT DOCUMENTS

| | | | |
|---|---|---|---|
| FR | 2381865 | A1 * | 9/1978 |
| JP | H0721168 | B2 * | 3/1995 |
| KR | 200435404 | Y1 * | 1/2007 |
| KR | 20090067661 | A * | 6/2009 |

* cited by examiner

SHED TUNNEL STRUCTURE FOR PREVENTING FALLING ROCK

CROSS REFERENCE TO RELATED APPLICATIONS

The present application claims the benefit of Chinese Patent Application No. 202110499603.0 filed on May 8, 2021, the contents of which are incorporated herein by reference in their entirety.

FIELD OF THE INVENTION

The present invention relates to the technical field of highway tunnel protection technologies, and in particular, to a shed tunnel structure for preventing a falling rock.

BACKGROUND OF THE INVENTION

Arranging a shed tunnel in a mountain area highway is an effective measure to deal with geological disasters of ramp failure and falling rocks. How to improve a capability of the shed tunnel in preventing impact of falling rocks is a focus of a shed tunnel design and research.

A structural design of the shed tunnel in preventing impact of falling rocks is mainly reflected in a structural design and a backfill design of a tunnel roof. Commonly used measures include use of an energy-dissipating support for a roof beam of a freely supported structure, tunnel roof backfill using a special buffer material or structure, tunnel roof backfill using a thick layer, and the like. The energy-dissipating support is made of a disposable material. After absorbing energy and being damaged in the case of one impact, the energy-dissipating support needs to be replaced in time to cope with the next impact, and the energy-dissipating support cannot cope with continuous impact of falling rocks.

BRIEF SUMMARY OF THE INVENTION

The purpose of the present invention is to provide a shed tunnel structure for preventing a falling rock, which can achieve the objective of resisting continuous impact of the falling rock through a structural design.

In order to achieve the above-mentioned purpose, the present invention is implemented by the following technical solution:

A shed tunnel structure for preventing a falling rock includes a shed tunnel body and a buffer plate for bearing impact of the falling rock, where the shed tunnel body includes a first supporting structure, and the first supporting structure is arranged on a side away from a ramp; one end of the buffer plate is connected to the ramp; a side face of the buffer plate close to the shed tunnel body is in contact with the first supporting structure, and the contact position is close to the other end of the buffer plate.

In the present invention, the shed tunnel body includes a tunnel roof and two supporting structures, where the two supporting structures support the tunnel roof, and the first supporting structure is farther from the ramp than a second supporting structure. One end of the buffer plate is a connecting end, and the connecting end is connected to the ramp, the other end of the buffer plate is a free end, and a side face of the free end close to the shed tunnel is in contact with the first supporting structure. When the falling rock on the ramp falls on the shed tunnel structure for preventing a falling rock, the buffer plate directly bears the falling rock.

After the buffer plate is subjected to an impact force of the falling rock, the contact position between the free end of the buffer plate and the first supporting structure moves relatively, and the buffer plate is elastically deformed to consume the impact force of the falling rock. The structure and the connection design of the buffer plate significantly increase a time of action between the falling rock and the shed tunnel and reduce the impact force acting on the shed tunnel, and the objective of resisting continuous impact of the falling rock can be achieved. The free end of the buffer plate is movably connected to the first supporting structure, and a length of extension can be changed continuously with increase of the falling rock. Compared with a fixed connection manner, the movable contact manner prevents the connection position between the buffer plate and the first supporting structure from being damaged by an excessive impact force when the buffer plate bears the falling rock, and prolongs the service life of the shed tunnel.

As a preferred solution of the present invention, the buffer plate is an arch plate. By designing the buffer plate into an arched structure, a slope of a side face of the buffer plate bearing the falling rock gradually decreases, which further expands the range of elastic deformation of the buffer plate and effectively enhances the anti-impact effect of the shed tunnel structure.

As a preferred solution of the present invention, the shed tunnel structure for preventing a falling rock further includes an anchor rod for connecting the buffer plate to the ramp, where the anchor rod is hinged to the buffer plate. Through the structural design of the anchor rod and the hinge, when the falling rock falls on the buffer plate, the connecting end of the buffer plate can rotate around the hinge position to ensure connection strength between the buffer plate and the anchor rod, and prevent the impact force borne by the buffer plate from affecting the connection between the buffer plate and the anchor rod, thereby further ensuring the service life of the shed tunnel structure.

As a preferred solution of the present invention, the shed tunnel structure for preventing a falling rock further includes a variable-stiffness pull rod assembly for supporting the buffer plate, where two ends of the variable-stiffness pull rod assembly are connected to two ends of the side face of the buffer plate close to the shed tunnel body respectively, a connecting end of the variable-stiffness pull rod assembly connected to the buffer plate is close to the ramp, and the other end thereof is close to the first supporting structure; the variable-stiffness pull rod assembly includes a pull rod and a variable-stiffness spring, the pull rod and the variable-stiffness spring are connected in series to form a rod-shaped structure, and two ends of the rod-shaped structure are connected to the two ends of the side face of the buffer plate close to shed tunnel body respectively.

As a preferred solution of the present invention, a stiffness curve of the variable-stiffness spring is a notching curve, and a slope of the notching curve gradually increases.

In the present invention, the variable-stiffness pull rod assembly is configured to support the buffer plate. When the falling rock falls on the buffer plate, the buffer plate is elastically deformed, and the variable-stiffness pull rod assembly is stretched. When the impact force is smaller, the deformation of the buffer plate is smaller, a stretched length of the variable-stiffness pull rod assembly is smaller, a tensile force provided by the variable-stiffness pull rod assembly is smaller, and in this state, the impact force of the falling rock is directly borne mainly by the buffer plate. When the impact force is larger, the deformation of the buffer plate is larger, the stretched length of the variable-stiffness pull rod assembly is larger, the tensile force provided by the variable-stiffness pull rod assembly is larger, and in this state, the buffer plate and the variable-stiffness pull rod assembly jointly bear the impact force of the falling rock. The variable-stiffness spring with the stiffness curve being the notching curve is used, so that stiffness of the variable-stiffness spring changes from small to large. As the elastic deformation gradually increases, a change in the impact resistance provided by the variable-stiffness spring gradually increases. When the elastic deformation is larger, the change in the impact resistance provided by the variable-stiffness pull rod assembly with the same amount of deformation is more obvious than that when the elastic deformation is smaller, which further ensures the anti-impact effect of the shed tunnel structure for preventing a falling rock in bearing the continuous impact of the falling rock.

As a preferred solution of the present invention, the shed tunnel structure for preventing a falling rock further includes a variable-stiffness pull rod assembly for supporting the buffer plate, where one end of the variable-stiffness pull rod assembly is connected to the side face of the buffer plate close to the shed tunnel body, and the connection position is close to the first supporting structure; the other end of the variable-stiffness pull rod assembly is connected to the ramp; the variable-stiffness pull rod assembly includes a pull rod and a variable-stiffness spring, the pull rod and the variable-stiffness spring are connected in series to form a rod-shaped structure, and two ends of the rod-shaped structure are connected to the two ends of the side face of the buffer plate close to shed tunnel body respectively.

In the present invention, through the position design of the variable-stiffness pull rod assembly, the top of one end of the variable-stiffness pull rod assembly is directly anchored to the ramp, so that the arched plate has larger deformation space and can bear larger impact of the falling rock.

As a preferred solution of the present invention, the buffer plate includes at least one first buffer unit and at least one second buffer unit, and the first buffer unit and the second buffer unit match each other to implement extension of the buffer plate; a matching side of the first buffer unit is provided with an L-shaped first lap joint portion, and the first lap joint portion includes an upper arm and a first side arm connected to the matching side of the first buffer unit; a matching side of the second buffer unit is provided with an L-shaped second lap joint portion, the second lap joint portion includes a lower arm and a second side arm connected to the matching side of the second buffer unit, and a lower surface of the first side arm and an upper surface of the second side wall match each other; through the structural design of the buffer plate, when the buffer plate bears the falling rock, lap joint positions between the buffer units are staggered, and impact of debris of the falling rock is borne by a tunnel roof backfill layer, thereby improving impact resistance of the shed tunnel structure.

As a preferred solution of the present invention, an end of the first supporting structure in contact with the buffer plate is provided with an arc-shaped steel plate. When the buffer plate bears the falling rock, the buffer plate is elastically deformed, and the buffer plate and the first supporting structure move relative to each other. By arranging the arc-shaped steel plate, structural strength of the first supporting structure is ensured when the steel plate is prevented from hindering relative movement of the buffer plate and the first supporting structure, and the relative movement between the buffer plate and the first supporting structure is prevented from affecting the contact position.

As a preferred solution of the present invention, a surface of the arc-shaped steel plate in contact with the buffer plate is a smooth surface, which reduces a friction coefficient between the buffer plate and the arc-shaped steel plate and ensures impact resistance of the buffer plate.

As a preferred solution of the present invention, the shed tunnel structure for preventing a falling rock further includes a backfill structure, where the backfill structure is arranged on a boundary side of the shed tunnel body and the ramp, as well as an upper side of the shed tunnel body. Through the structural design of the backfill structure, the impact force of the falling rock is prevented from being directly borne by the tunnel roof of the shed tunnel body, thereby further ensuring the service life of the shed tunnel.

Compared with the prior art, the present invention has the following beneficial effects:

1. The present invention relates to the shed tunnel structure for preventing a falling rock. Through the structural design, the problem of continuous impact of the falling rock is solved, and the service life of an anti-impact structure is prolonged.
2. The present invention relates to the shed tunnel structure for preventing a falling rock. By designing the buffer plate into an arched structure, the range of elastic deformation of the buffer plate is further expanded, and the anti-impact effect of the shed tunnel structure is effectively enhanced.
3. The present invention relates to the shed tunnel structure for preventing a falling rock. Through the structural design of the variable-stiffness pull rod assembly, the anti-impact effect of the shed tunnel structure for preventing a falling rock in bearing continuous impact of the falling rock is further ensured.
4. The present invention relates to the shed tunnel structure for preventing a falling rock. Through the structural design of a plurality of buffer units, when the buffer plate bears the falling rock, lap joint positions between the buffer units are staggered, and impact of debris of the falling rock is borne by a tunnel roof backfill layer, thereby improving impact resistance of the shed tunnel structure.
5. The present invention relates to the shed tunnel structure for preventing a falling rock. By arranging the arc-shaped steel plate, structural strength of the first supporting structure is ensured when the steel plate is prevented from hindering relative movement of the buffer plate and the first supporting structure, and the relative movement between the buffer plate and the first supporting structure is prevented from affecting the contact position.

DETAILED DESCRIPTION OF THE PREFERRED EMBODIMENTS

To make the objectives, technical solutions and advantages of the present invention clearer, the present invention is further described in detail below with reference to embodiments and drawings. The schematic implementations of the present invention and descriptions thereof are only used to explain the present invention, and are not intended to limit the present invention.

In the following description, numerous specific details are set forth to provide a thorough understanding of the present invention. It will be obvious, however, to a person of ordinary skill in the art that these specific details need not be used to practice the present invention. In other embodiments, conventional structures are not described in detail to avoid obscuring the present invention.

Throughout this specification, reference to "an embodiment", "embodiment" means that a particular feature, structure, or characteristic described with reference to this embodiment or example is included in at least one embodiment of the present invention. Therefore, the phrase "an embodiment", "embodiment" in various places throughout this specification does not necessarily refer to the same embodiment or example. Furthermore, particular features, structures or characteristics may be combined in any suitable combination and/or sub-combination in one or more embodiments. In addition, a person of ordinary skill in the art should understand that the drawings provided herein are for illustrative purposes and that the drawings are not necessarily drawn to scale. As used herein, the term "and/or" includes any and all combinations of one or more related listed items.

Embodiment

Figure 1:
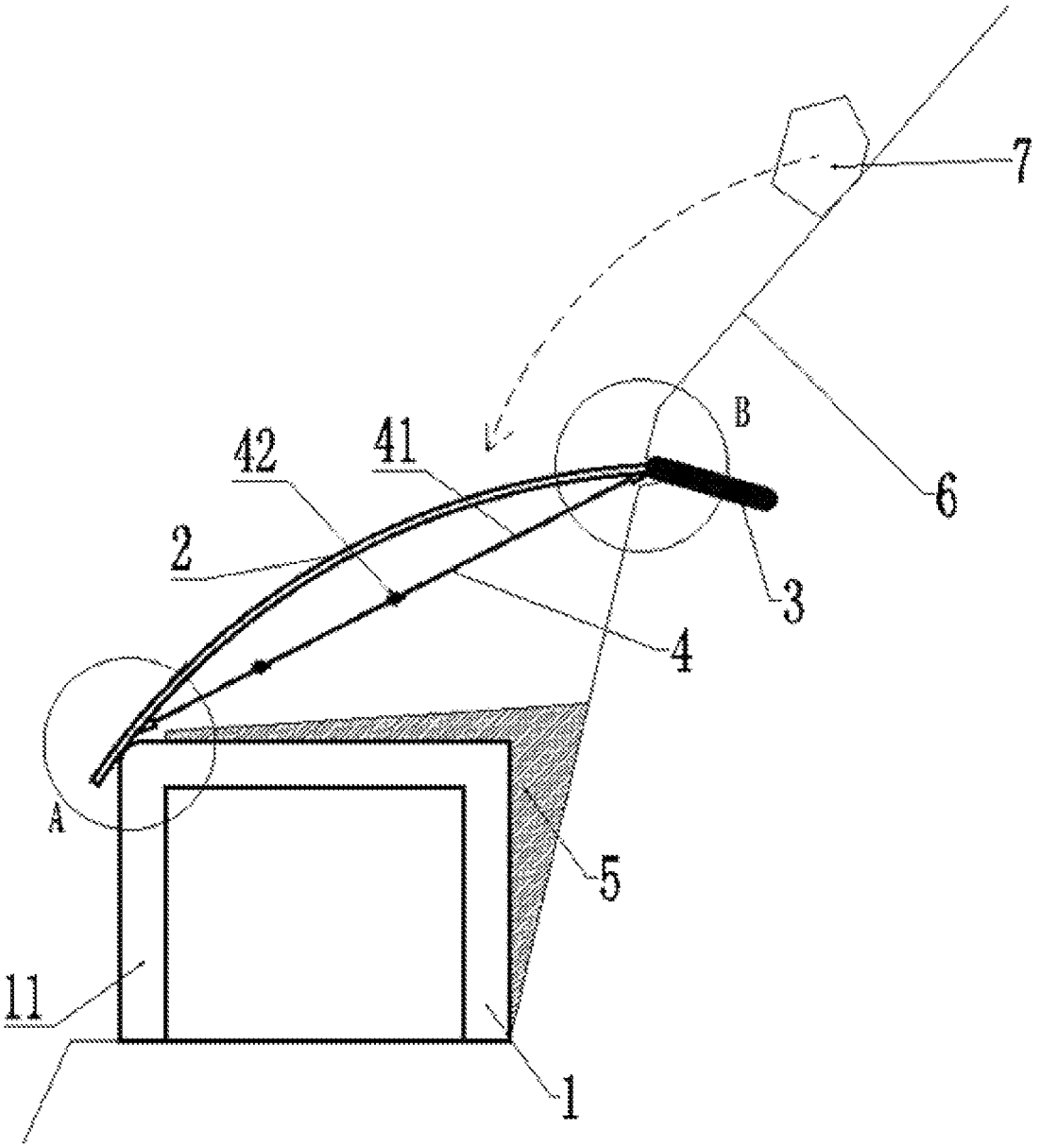
FIG. 1 is a schematic structural diagram according to an embodiment of the present invention.
Figure 2:
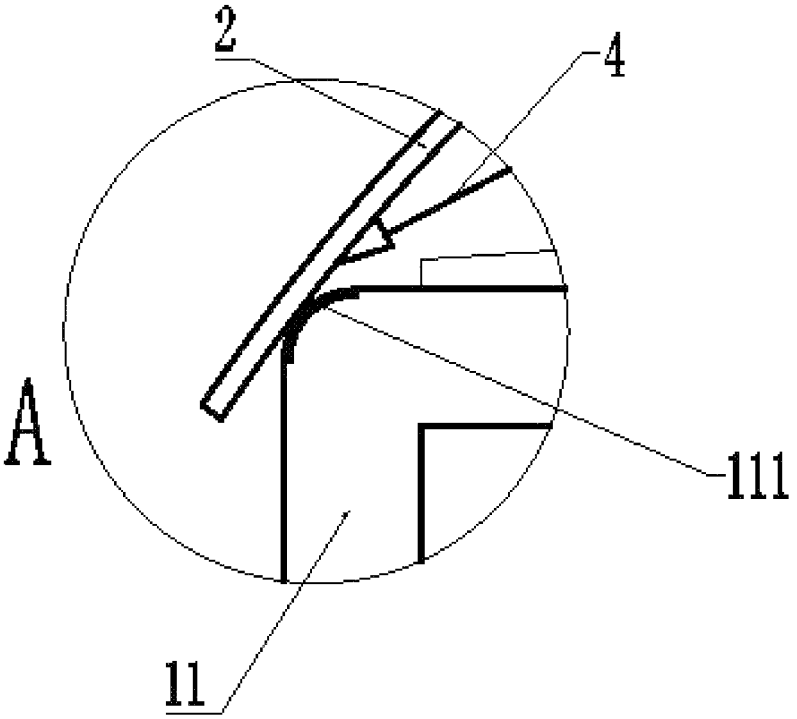
FIG. 2 is a partial enlarged view of a region A in FIG. 1 according to an embodiment of the present invention.

As shown in FIG. 1 and FIG. 2, a shed tunnel structure for preventing a falling rock 7 includes a shed tunnel body 1 and a buffer plate 2 for bearing impact of the falling rock 7, where the shed tunnel body 1 includes a first supporting structure 11, and the first supporting structure 11 is arranged on a side away from a ramp 6; one end of the buffer plate 2 is connected to the ramp 6; a side face of the buffer plate 2 close to the shed tunnel body 1 is in contact with the first supporting structure 11, and the contact position is close to the other end of the buffer plate 2

In a specific implementation, the buffer plate 2 has a structure having characteristics of large elastic deformation and high toughness, and preferably, the buffer plate 2 is a thick steel plate.

In the present invention, the shed tunnel body 1 includes a tunnel roof and two supporting structures, where the two supporting structures support the tunnel roof, and the first supporting structure 11 is farther from the ramp 6 than the second supporting structure. One end of the buffer plate 2 is a connecting end, and the connecting end is connected to the ramp 6, the other end of the buffer plate 2 is a free end, and a side face of the free end close to the shed tunnel is in contact with the first supporting structure 11. When the falling rock 7 on the ramp 6 falls on the shed tunnel structure for preventing a falling rock 7, the buffer plate 2 directly bears the falling rock 7. After the buffer plate 2 is subjected to an impact force of the falling rock 7, the contact position between the free end of the buffer plate 2 and the first supporting structure 11 moves relatively, and the buffer plate 2 is elastically deformed to consume the impact force of the falling rock 7. The structure and the connection design of the buffer plate 2 significantly increase a time of action between the falling rock 7 and the shed tunnel and reduce the impact force acting on the shed tunnel, and the objective of resisting continuous impact of the falling rock 7 can be achieved. The free end of the buffer plate 2 is movably connected to the first supporting structure 11, and a length of extension can be changed continuously with increase of the falling rock 7. Compared with a fixed connection manner, the movable contact manner prevents the connection position between the buffer plate 2 and the first supporting structure 11 from being damaged by an excessive impact force when the buffer plate 2 bears the falling rock 7, and prolongs the service life of the shed tunnel.

As a preferred solution of the present invention, the buffer plate 2 is an arch plate. By designing the buffer plate 2 into an arched structure, a slope of a side face of the buffer plate 2 bearing the falling rock 7 gradually decreases, which further expands the range of elastic deformation of the buffer plate 2 and effectively enhances the anti-impact effect of the shed tunnel structure.

Figure 3:
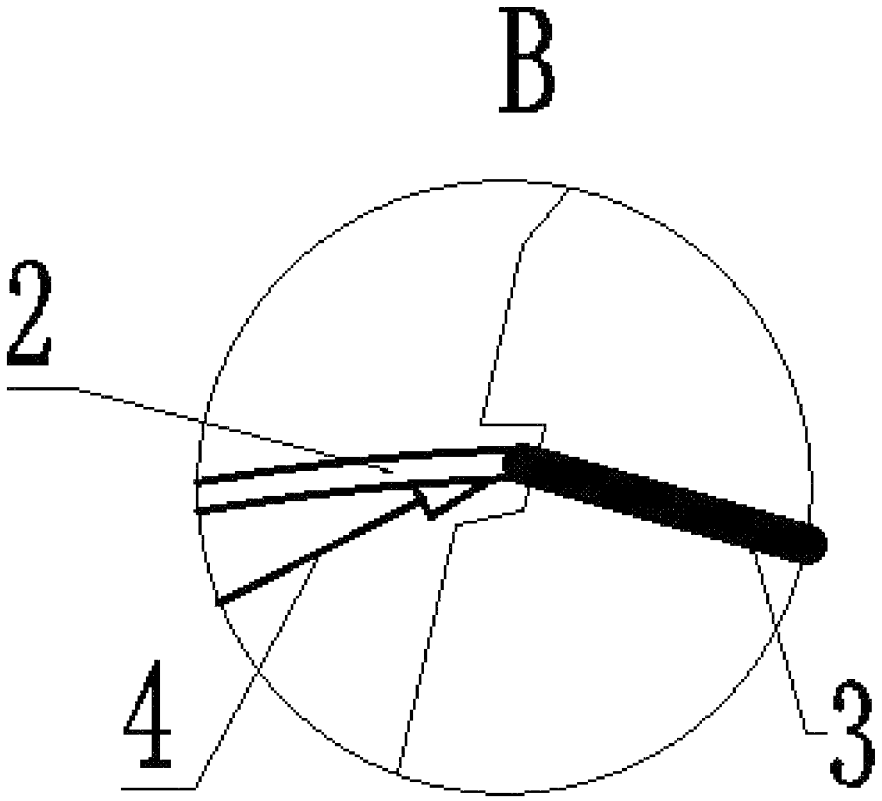
FIG. 3 is a partial enlarged view of a region B in FIG. 1 according to an embodiment of the present invention.

As shown in FIG. 3, the shed tunnel structure for preventing a falling rock further includes an anchor rod 3 for connecting the buffer plate 2 to the ramp 6, where the anchor rod 3 is hinged to the buffer plate 2. Through the structural design of the anchor rod 3 and the hinge, when the falling rock 7 falls on the buffer plate 2, the connecting end of the buffer plate 2 can rotate around the hinge position to ensure connection strength between the buffer plate 2 and the anchor rod 3, and prevent the impact force borne by the buffer plate 2 from affecting the connection between the buffer plate 2 and the anchor rod 3, thereby further ensuring the service life of the shed tunnel structure.

In a specific implementation, the hinge position may be arranged at an end or middle of the anchor rod 3, and preferably, the hinge position is arranged at the end of the anchor rod 3, to facilitate construction.

In a specific implementation, the anchor rod 3 can be inserted into the ramp 6 parallel to the horizontal plane, or may be inserted into ramp 6 upward or downward. Preferably, the anchor rod 3 is inserted into the ramp 6 obliquely downward, and an oblique and downward insertion manner ensures fixing strength between the anchor rod 3 and the ramp 6 and improves connection stability.

In a specific implementation, as shown in FIG. 3, the connection position between the buffer plate 2 and the anchor rod 3 is arranged inside the ramp 6, that is, a surface of the ramp 6 is provided with a groove. Through the structural arrangement of the groove, the falling rock 7 is prevented from impacting on the connection position to affect connection strength of the buffer plate 2.

As shown in FIG. 1, the shed tunnel structure for preventing a falling rock further includes a variable-stiffness pull rod assembly 4 for supporting the buffer plate 2, where two ends of the variable-stiffness pull rod assembly 4 are connected to two ends of the side face of the buffer plate 2 close to the shed tunnel body 1 respectively, a connecting end of the variable-stiffness pull rod assembly 4 connected to the buffer plate 2 is close to the ramp 6, and the other end thereof is close to the first supporting structure 11; the variable-stiffness pull rod assembly 4 includes a pull rod and a variable-stiffness spring 42, the pull rod 41 and the variable-stiffness spring 42 are connected in series to form a rod-shaped structure, and two ends of the rod-shaped structure are connected to the two ends of the side face of the buffer plate 2 close to shed tunnel body 1 respectively.

Figure 7:
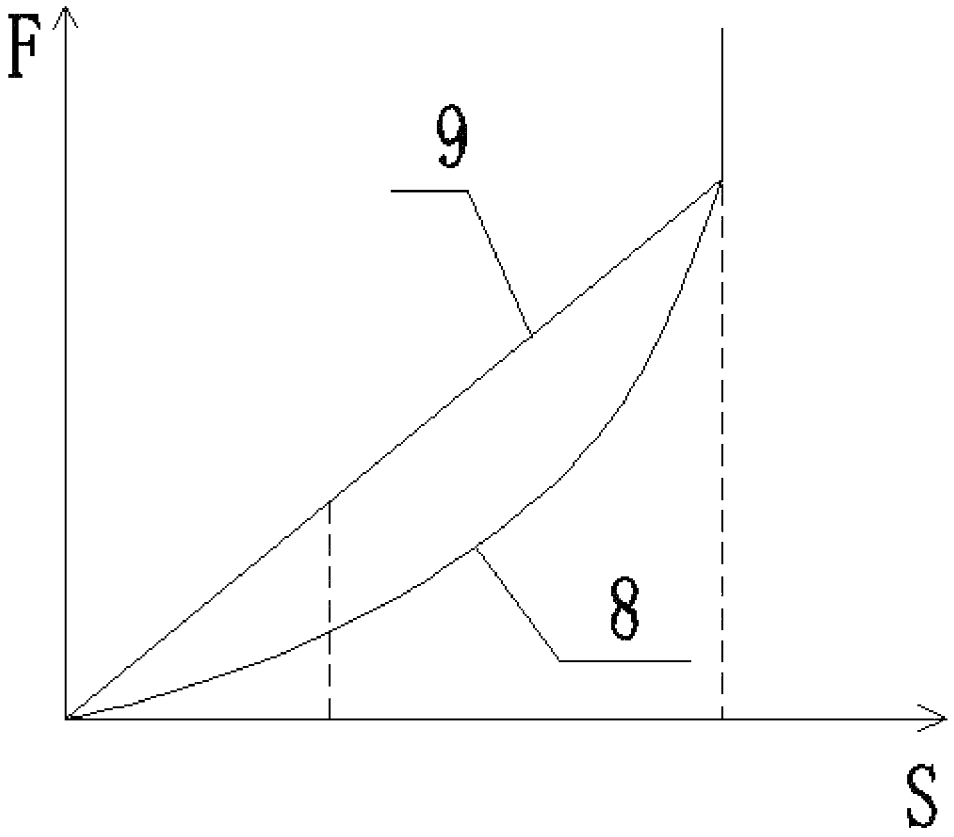
FIG. 7 is a schematic diagram of a stiffness curve of a variable-stiffness spring according to an embodiment of the present invention.

As shown in FIG. 7, a horizontal coordinate S is a tensile deformation of the spring, and a vertical coordinate F is a tensile force. In a certain tensile deformation range, a stiffness curve 8 of the variable-stiffness spring is a notching curve, and a slope of the notching curve gradually increases; and a stiffness curve 9 of a constant-stiffness spring is a straight line.

In the present invention, the variable-stiffness pull rod assembly 4 is configured to support the buffer plate 2. When the falling rock 7 falls on the buffer plate 2, the buffer plate 2 is elastically deformed, and the variable-stiffness pull rod assembly 4 is stretched. When the impact force is smaller, the deformation of the buffer plate 2 is smaller, a stretched length of the variable-stiffness pull rod assembly 4 is smaller, a tensile force provided by the variable-stiffness pull rod assembly 4 is smaller, and in this state, the impact force of the falling rock 7 is directly borne mainly by the buffer plate 2. When the impact force is larger, the deformation of the buffer plate 2 is larger, the stretched length of the variable-stiffness pull rod assembly 4 is larger, the tensile force provided by the variable-stiffness pull rod assembly 4 is larger, and in this state, the buffer plate 2 and the variable-stiffness pull rod assembly 4 jointly bear the impact force of the falling rock 7. The variable-stiffness spring 42 with the stiffness curve being the notching curve is used, so that stiffness of the variable-stiffness spring 42 changes from small to large. As the elastic deformation gradually increases, a change in the impact resistance provided by the variable-stiffness spring 42 gradually increases. When the elastic deformation is larger, the change in the impact resistance provided by the variable-stiffness pull rod assembly 4 with the same amount of deformation is more obvious than when the elastic deformation is smaller, which further ensures the anti-impact effect of the shed tunnel structure for preventing a falling rock 7 in bearing the continuous impact of the falling rock 7.

In a specific implementation, when the buffer plate 2 is in a flat state after being subjected to impact of the falling rock 7, a connecting end of the variable-stiffness pull rod assembly 4 close to the first supporting structure 11 is located on a side of a contact position between the buffer plate 2 and the first supporting structure 11 close to the ramp 6.

Figure 4:
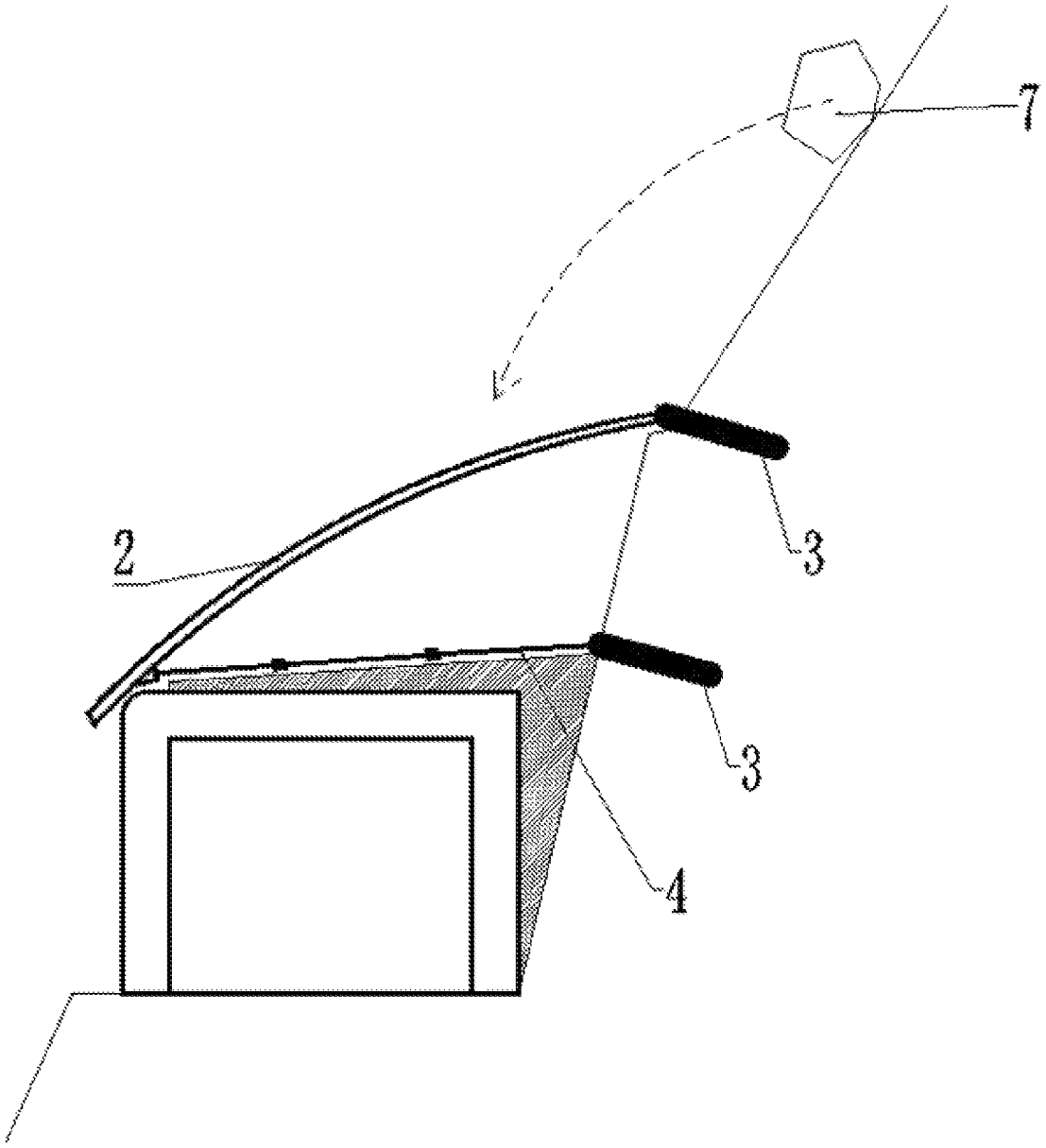
FIG. 4 is a schematic structural diagram according to an embodiment of the present invention.

As shown in FIG. 4, the shed tunnel structure for preventing a falling rock further includes a variable-stiffness pull rod assembly 4 for supporting the buffer plate 2, where one end of the variable-stiffness pull rod assembly 4 is connected to the side face of the buffer plate 2 close to the shed tunnel body 1, and the connection position is close to the first supporting structure 11; the other end of the variable-stiffness pull rod assembly 4 is connected to the ramp 6; the variable-stiffness pull rod assembly 4 includes a pull rod 41 and a variable-stiffness spring 42, the pull rod 41 and the variable-stiffness spring 42 are connected in series to form a rod-shaped structure, and two ends of the rod-shaped structure are connected to the two ends of the side face of the buffer plate 2 close to shed tunnel body 1 respectively.

In the present invention, through the position design of the variable-stiffness pull rod assembly 4, the top of one end of the variable-stiffness pull rod assembly 4 is directly anchored to the ramp, so that the arched plate has larger deformation space and can bear larger impact of the falling rock 7.

In a specific implementation, the variable-stiffness pull rod assembly 4 includes a pull rod 41 and a variable-stiffness spring 42, where the pull rod 41 and the variable-stiffness spring 42 are connected in series. One end of the pull rod 41 may be connected to the buffer plate 2, the other end thereof is connected to the variable-stiffness spring 42, and the other end of the variable-stiffness spring 42 is connected to the buffer plate 2; or one end of the pull rod 41 may be connected to the buffer plate 2, the other end thereof is connected to the variable-stiffness spring 42, the other end of the variable-stiffness spring 42 is connected to one end of another pull rod 41, and the other end of the another pull rod 41 is connected to the buffer plate 2; or one end of the variable-stiffness spring 42 may be connected to the buffer plate 2, the other end thereof is connected to the pull rod 41, the other end of the pull rod 41 is connected to one end of another variable-stiffness spring 42, and the other end of the another variable-stiffness spring 42 is connected to the buffer plate 2; one or more variable-stiffness springs 42 may be connected between two pull rods 41; preferably, the pull rod 41 and the variable-stiffness spring 42 are arranged at an interval, which is similar to that a complete rod piece is provided with at least one fracture, two ends of the rod piece are connected to the buffer plate 2, and a variable-stiffness spring 42 is arranged at the fracture position.

Figure 5:
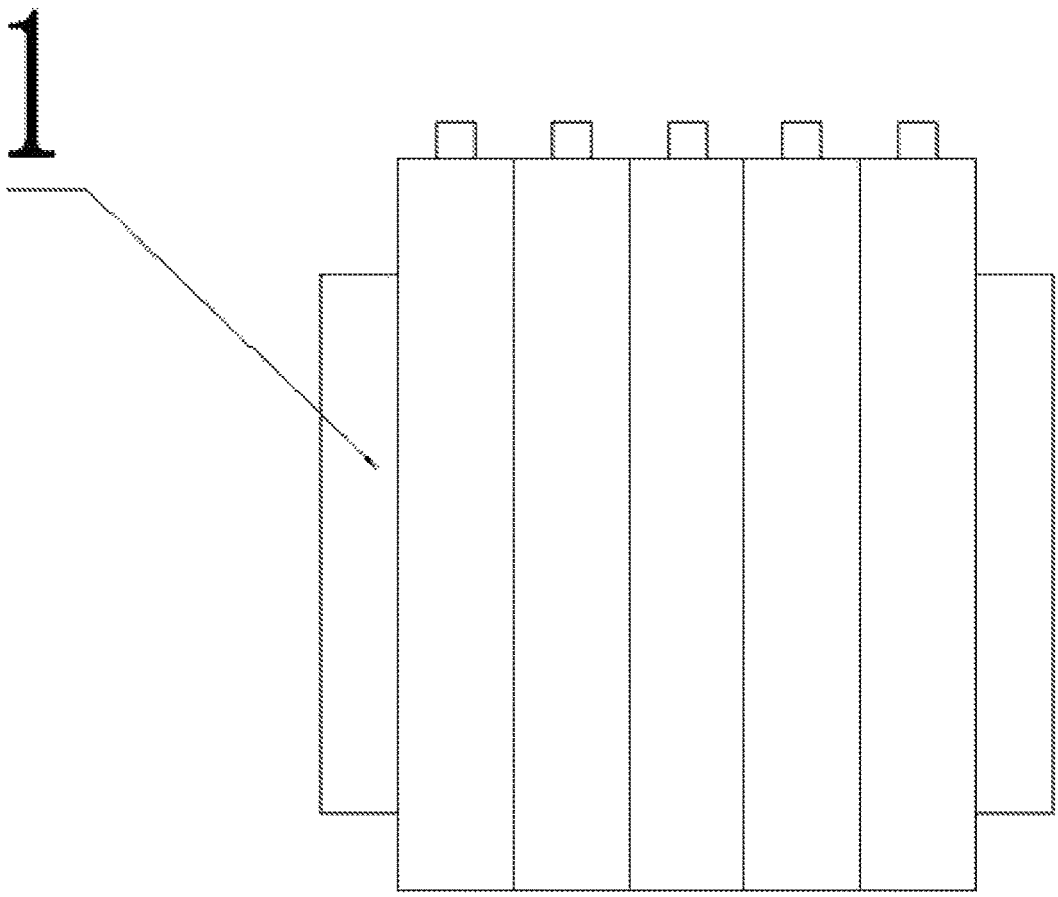
FIG. 5 is a top view diagram according to an embodiment of the present invention.
Figure 6:
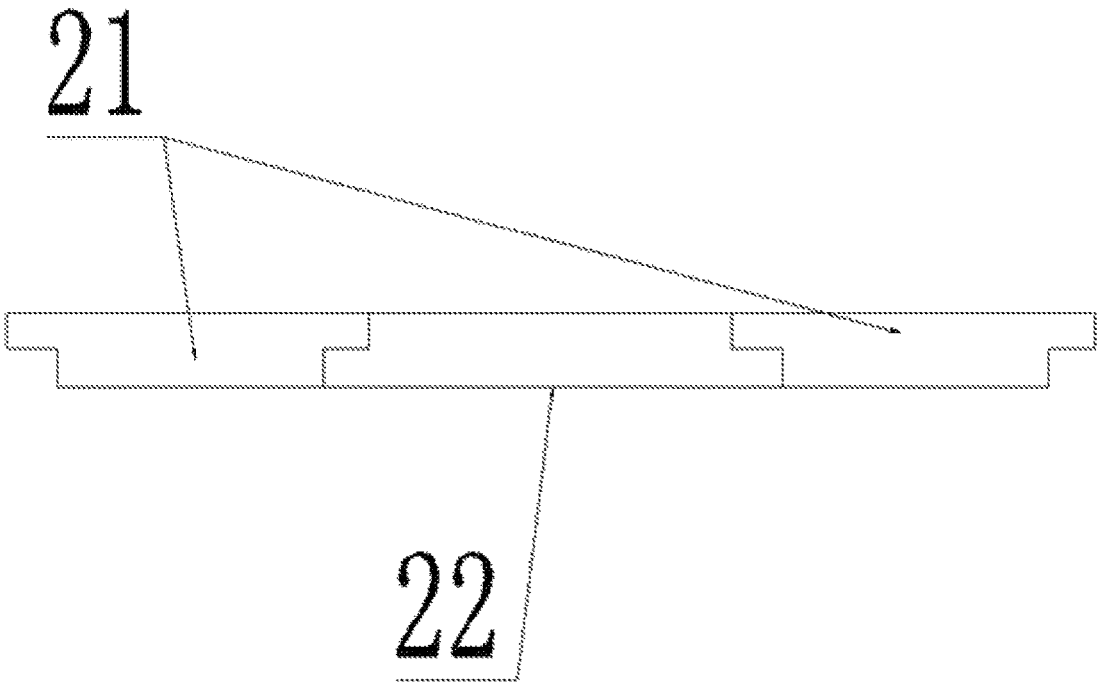
FIG. 6 is a front view diagram of a buffer plate according to an embodiment of the present invention.

As shown in FIG. 5 and FIG. 6, the buffer plate 2 includes at least one first buffer unit 21 and at least one second buffer unit 22, and the first buffer unit 21 and the second buffer unit 22 match each other to implement extension of the buffer plate 2; a matching side of the first buffer unit 21 is provided with an L-shaped first lap joint portion, and the first lap joint portion includes an upper arm and a first side arm connected to the matching side of the first buffer unit 21; a matching side of the second buffer unit 22 is provided with an L-shaped second lap joint portion, the second lap joint portion includes a lower arm and a second side arm connected to the matching side of the second buffer unit 22, and a lower surface of the first side arm and an upper surface of the second side wall match each other; through the structural design of the buffer plate 2, when the buffer plate 2 bears the falling rock 7, lap joint positions between the buffer units are staggered, and impact of debris of the falling rock 7 is borne by a tunnel roof backfill layer, thereby improving impact resistance of the shed tunnel structure.

As shown in FIG. 2, an end of the first supporting structure 11 in contact with the buffer plate 2 is provided with an arc-shaped steel plate 111. When the buffer plate 2 bears the falling rock 7, the buffer plate 2 is elastically deformed, and the buffer plate 2 and the first supporting structure 11 move relative to each other. By arranging the arc-shaped steel plate 111, structural strength of the first supporting structure 11 is ensured when the steel plate is prevented from hindering relative movement of the buffer plate 2 and the first supporting structure 11, and the relative movement between the buffer plate 2 and the first supporting structure 11 is prevented from affecting the contact position.

Preferably, a surface of the arc-shaped steel plate 111 in contact with the buffer plate 2 is a smooth surface, which reduces a friction coefficient between the buffer plate 2 and the arc-shaped steel plate 111 and ensures impact resistance of the buffer plate 2.

As shown in FIG. 1, the shed tunnel structure for preventing a falling rock further includes a backfill structure 5, where the backfill structure 5 is arranged on a boundary side of the shed tunnel body 1 and the ramp 6, as well as an upper side of the shed tunnel body 1. Through the structural design of the backfill structure 5, the impact force of the falling rock 7 is prevented from being directly borne by the tunnel roof of the shed tunnel body 1, thereby further ensuring the service life of the shed tunnel.

The specific implementations described above further describe the objectives, technical solutions and beneficial effects of the present invention in detail. It should be understood that the foregoing descriptions are only specific implementations of the present invention and are not intended to limit the protection scope of the present invention. Any modification, equivalent replacement, improvement, and the like made within the spirit and principle of the present invention shall fall within the protection scope of the present invention.

What is claimed is:

1. A shed tunnel structure for preventing a falling rock, comprising a shed tunnel body and a buffer plate for bearing impact of the falling rock;

wherein the shed tunnel body comprises a first supporting structure, and the first supporting structure is arranged on a side away from a ramp; one end of the buffer plate is connected to the ramp;

a side face of the buffer plate close to the shed tunnel body is in movable contact with the first supporting structure, and the contact position is close to the other end of the buffer plate; and the buffer plate comprises at least one first buffer unit and at least one second buffer unit, the first buffer unit and the second buffer unit match each other to implement extension of the buffer plate;

a matching side of the first buffer unit is provided with an L-shaped first lap joint portion, and the first lap joint portion comprises an upper arm and a first side arm connected to the matching side of the first buffer unit; a matching side of the second buffer unit is provided with an L-shaped second lap joint portion, the second lap joint portion comprises a lower arm and a second side arm connected to the matching side of the second buffer unit, and a lower surface of the first side arm and an upper surface of the second side wall match each other; when the buffer plate bears the falling rock, lap joint positions between the buffer units are staggered, and impact of debris of the falling rock is borne by a tunnel roof backfill layer.

2. The shed tunnel structure for preventing a falling rock according to claim 1, wherein the buffer plate is an arch plate, and a slope of a side face of the buffer plate bearing the falling rock gradually decreases.

3. The shed tunnel structure for preventing a falling rock according to claim 1, further comprising an anchor rod for connecting the buffer plate to the ramp, wherein the anchor rod is hinged to the buffer plate.

4. The shed tunnel structure for preventing a falling rock according to claim 1, further comprising a variable-stiffness pull rod assembly for supporting the buffer plate, wherein two ends of the variable-stiffness pull rod assembly are connected to two ends of the side face of the buffer plate close to the shed tunnel body respectively, a connecting end of the variable-stiffness pull rod assembly connected to the buffer plate is close to the ramp, and the other end thereof is close to the first supporting structure.

5. The shed tunnel structure for preventing a falling rock according to claim 1, further comprising a variable-stiffness pull rod assembly for supporting the buffer plate, wherein one end of the variable-stiffness pull rod assembly is connected to the side face of the buffer plate close to the shed tunnel body, and the connection position is close to the first supporting structure; and the other end of the variable-stiffness pull rod assembly is connected to the ramp.

6. The shed tunnel structure for preventing a falling rock according to claim 4, wherein the variable-stiffness pull rod assembly comprises a pull rod and a variable-stiffness spring, the pull rod and the variable-stiffness spring are connected in series to form a rod-shaped structure, and two ends of the rod-shaped structure are connected to the two ends of the side face of the buffer plate close to the shed tunnel body respectively.

7. The shed tunnel structure for preventing a falling rock according to claim 5, wherein the variable-stiffness pull rod assembly comprises a pull rod and a variable-stiffness spring, the pull rod and the variable-stiffness spring are connected in series to form a rod-shaped structure, and two ends of the rod-shaped structure are connected to the two ends of the side face of the buffer plate close to the shed tunnel body respectively.

8. The shed tunnel structure for preventing a falling rock according to claim 6, wherein a stiffness curve of the variable-stiffness spring is a notching curve, and a slope of the notching curve gradually increases.

9. The shed tunnel structure for preventing a falling rock according to claim 1, wherein an end of the first supporting structure in contact with the buffer plate is provided with an arc-shaped steel plate.

10. The shed tunnel structure for preventing a falling rock according to claim 1, further comprising a backfill structure, wherein the backfill structure is arranged on a boundary side of the shed tunnel body and the ramp, as well as an upper side of the shed tunnel body.

* * * * *